US005344147A

United States Patent [19]

Lee

[11] Patent Number: 5,344,147

[45] Date of Patent: Sep. 6, 1994

[54] MULTI-CUBE PUZZLE

[76] Inventor: Sang-dae Lee, 1403-403, Mokdong Apartment, 329 Sinjung-6 dong, Yangchun-ku, Rep. of Korea

[21] Appl. No.: 946,840

[22] Filed: Sep. 18, 1992

[30] Foreign Application Priority Data

Oct. 28, 1991 [KR] Rep. of Korea ..... 1991/19000
Jul. 7, 1992 [KR] Rep. of Korea ..... 1992/12040

[51] Int. Cl.[5] ..... A63F 9/08
[52] U.S. Cl. ..... 273/153 S
[58] Field of Search ..... 273/153 S, 153 R

[56] References Cited

U.S. PATENT DOCUMENTS 498,639 5/1893 Fields ..... 273/153 S
3,523,384 8/1970 Adelsohn ..... 446/121
3,841,638 10/1974 Sinden ..... 273/153 S
4,511,144 4/1985 Roberts ..... 273/153 S

FOREIGN PATENT DOCUMENTS 0042772 12/1981 European Pat. Off. ..... 273/153 S
1423136 9/1988 U.S.S.R. ..... 273/153 S
2064965 6/1981 United Kingdom ..... 273/153 S
2100134 12/1982 United Kingdom ..... 273/153 S

*Primary Examiner*—V. Millin
*Assistant Examiner*—Steven B. Wong
*Attorney, Agent, or Firm*—Finnegan, Henderson, Farabow, Garrett & Dunner

[57] ABSTRACT

Multi-Cube puzzle for arranging edge lines marked on cubic elements in a pattern along the edges of the multi-cube puzzle. The multi-cube puzzle is comprised of a body assembly with a fabricated with the central core and body elements connected with screws, twelve side cubic elements inserted around the body assembly able to move around tracks formed by flanges extending from the body elements, six corner cubic elements and a dotted corner cubic element.

12 Claims, 10 Drawing Sheets

MULTI-CUBE PUZZLE

BACKGROUND OF THE INVENTION

This invention is related to a multi-cube puzzle. In particular, the present invention is directed to an amusing toy which has a cube element taken out of the multi-cube puzzle, so each cubic element can be moved linearly in a straight line. Each cubic element includes edge lines, such that the edge lines can be arranged to make a complete square on each face of the big cube in the same color. Therefore, a player can enjoy arranging the edge lines marked on the cubic elements in a line along the edges.

In the prior art, a standard version of a cubic puzzle or multi-cube puzzle has been introduced to the market and been popular all over the world. This puzzle involved mixing and scattering cubic elements of three different colors (for example, red, blue and green; or yellow, white and chrome yellow), and then putting them back in order so that each s&de of the big cube would be of a same color.

Therefore this invention develops the idea further, using colored edge lines rather than entire faces to signify the solution of the puzzle.

DESCRIPTION OF MAIN NUMBERS IN THE DRAWINGS

1...multi-cube puzzle, 2,20...body element, 3,33...cubic element, 3A,13A...blue edge line, 3B,13B...red edge line, 33A,33B...marked dot, 21...flange, 25...track, 5...screw, 100...body assembly, 50...central core, 20A...leg, 20B...fixing member, 51...projected member, 133...side cubic element.

DESCRIPTION OF THE PREFERRED EMBODIMENT

The structure of the multi-cube puzzle and the method of using the multi-cube puzzle according to this invention will be described in detail with reference to the following drawings.

In accordance with the present invention, a multi-cube puzzle is provided with a plurality of linearly moveable cubic elements. The various cubic elements selectively include edge lines of different colors to enable the user to arrange the cubic elements of the multi-cube puzzle in a variety of patterns.

Figure 1:
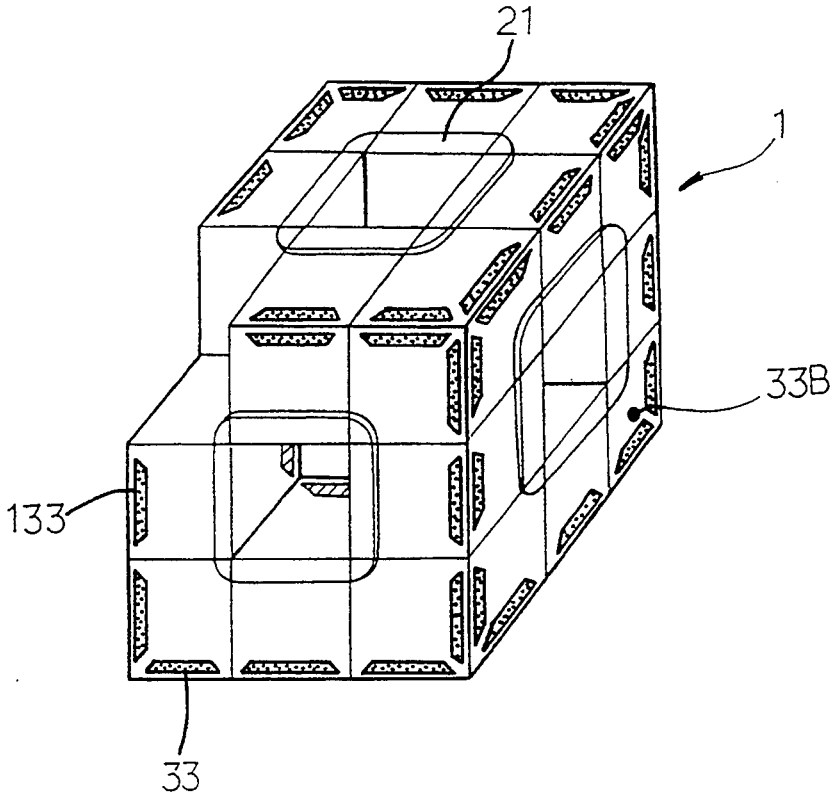
FIG. 1 is a perspective view of the multi-cube puzzle arranged with edge lines of the same color along the edges of the multi-cube puzzle.
Figure 2:
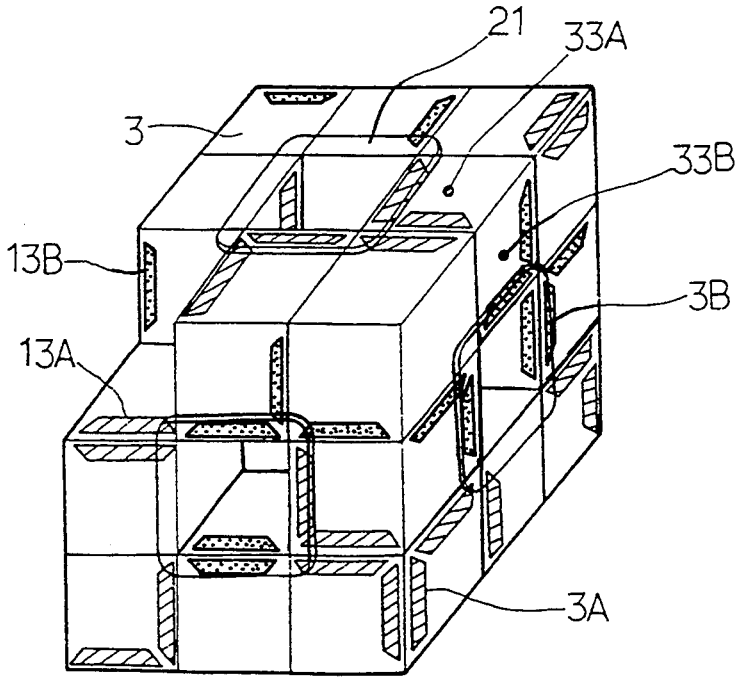
FIG. 2 is a perspective view of the multi-cube puzzle 1 in which the cubic elements are randomly scattered.
Figure 3:
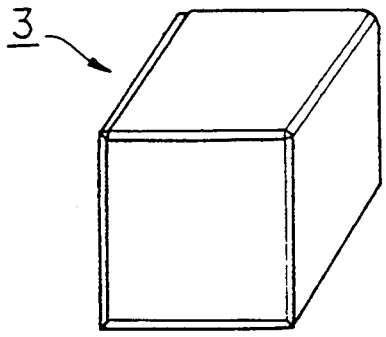
FIG. 3 is a perspective view of a cubic element 3 which is a constituent part of the puzzle.
Figure 4:
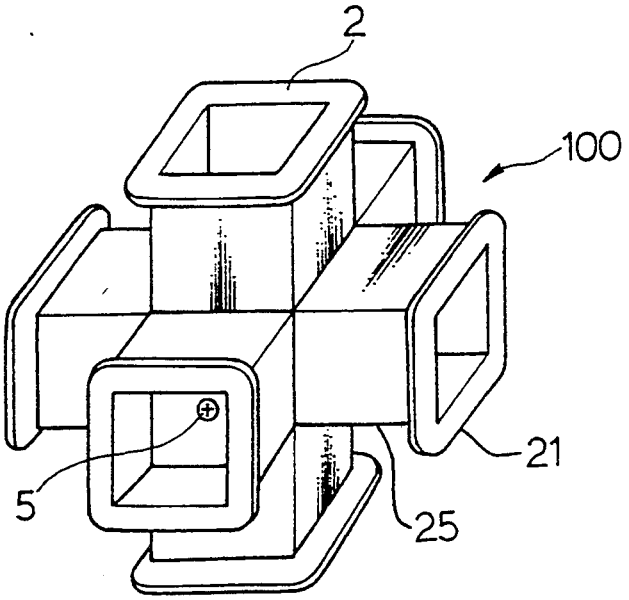
FIG. 4 is a perspective view of the body assembly 100 which is composed of body elements 2.
Figure 5:
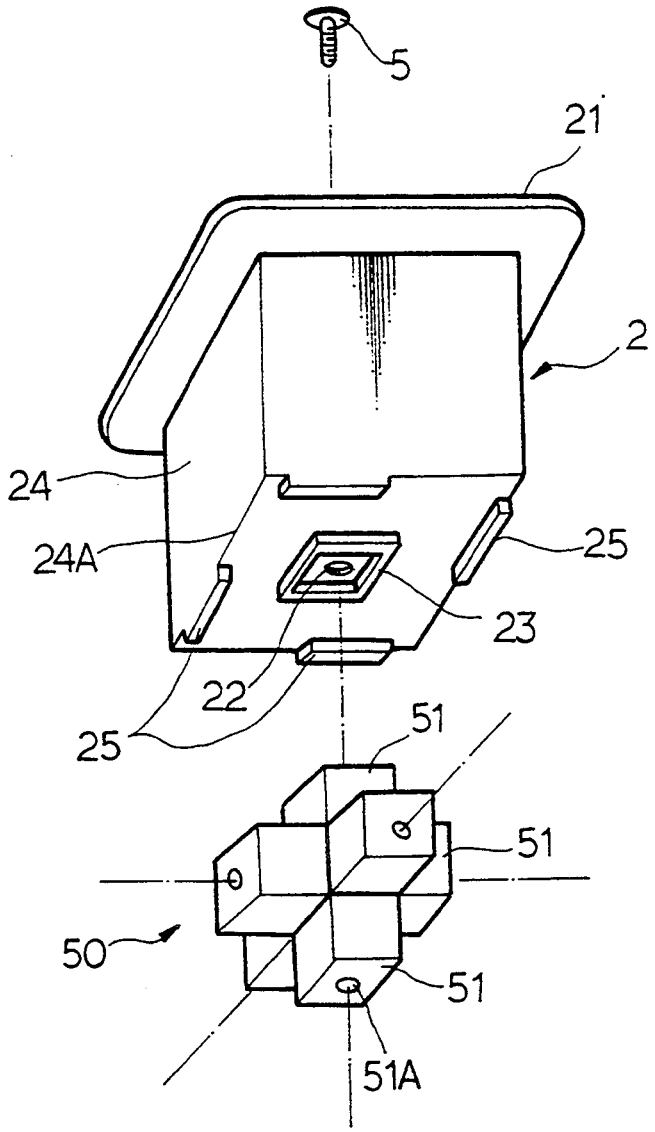
FIG. 5 is a disassembled perspective view of central core 51 and body elements 2 with a screw 5, aligned for assembly.

As embodied herein, FIG. 1 is a perspective view of the multi-cube puzzle arranged with red edge lines forming a coherent pattern and FIG. 2 is a perspective view of the multi-cube puzzle 1 with the cubic elements in a scattered state. FIG. 3 is a perspective of a cubic element constituting the multi-cube puzzle 1 and FIG. 4 is a perspective view of the body assembly 10 composed of body elements 2. FIG. 5 is a disassembled perspective view of the central core 51 and body elements 2 with a screw 5, aligned for assembly.

Preferably, each body element 2 of the body assembly 100 is made of transparent plastic and has a cubic structure, the top of which is hollow with flanges with rounded corners as shown in FIG. 5. The body element 2 has a screw hole 22 in the center of the bottom part 24A to fix the body element 2 to the central core 50. The bottom part 24A of the body element has four legs 25 along the side of the bottom, each of which is half the dimension of one side, to be cross-combined with the corresponding leg of another body element positioned at a right angle to the first body element.

As shown in FIG. 4, the projected member 51 of the central core 50 of the preferred embodiment is inserted into a rectangular member 23 of the body element 2 to fix the body element 2 to the central core 50, and to form the body assembly 100. The central core 50 which is made of plastic, has six projected members 51 facing in six directions, on which screw holes 51A are installed in order to fix the body elements 2 to the central core 50 with screws 5. The legs 25 of body element 2 strengthen the combination between the body elements 2. The rectangular member 23, at the bottom part 24A of the body element 2, receives the projected member 51 of the central core 50 to firmly join the body element 2 and the central core 50 with the screw 5. When the six body elements 2 are joined with the central core 50, the body assembly 100 is completed as shown in FIG. 4 with the body elements extending radially outward.

The cubic elements, generally referred to by reference character 3 and as shown in FIG. 3, are inserted between the body elements 2 and supported by the flanges 21 in order to move in the body assembly 100 and to set up the multi-cube puzzle as shown in FIG. 1. As seen in FIG. 4, the flanges 21 form tracks 25 which extend in at least three different directions around the body assembly 100 for linear movement of the cubic elements 3. The edge lines 3A, 3B of cubic elements 3, when covered by the flanges 21 of body elements 2, or the insides of the body elements 2, that is, the side walls 24 and the bottom part 24A of the body element 2, can be easily seen, because the body elements 2 are made of transparent plastic materials and the insides of the body elements 2 are empty.

Figure 6A:
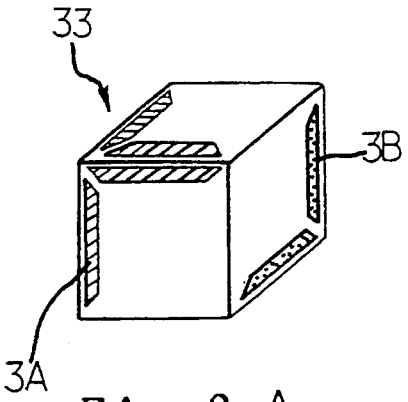
FIG. 6A is a perspective view of cubic element 33.
Figure 6B:
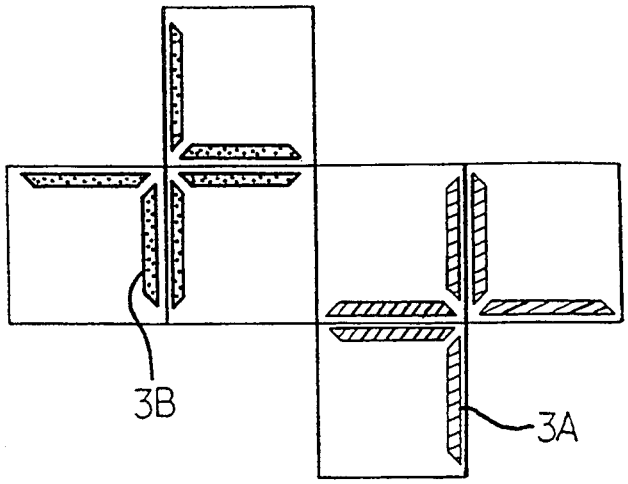
FIG. 6B is an expanded view of cubic element 33 in FIG. 6A.
Figure 7A:
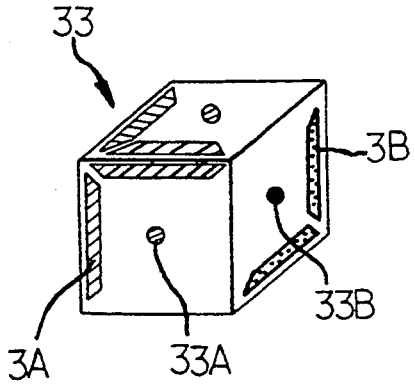
FIG. 7A is a perspective view of cubic element 33 marked with dots 33A and 33B.
Figure 7B:
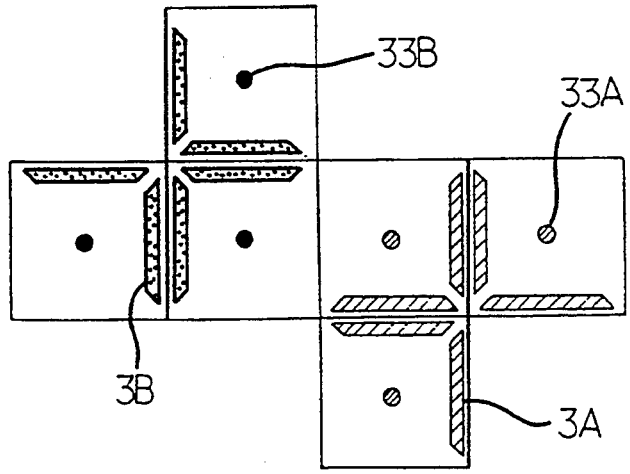
FIG. 7B is an expanded view of cubic element 33 in FIG. 7A.
Figure 8A:
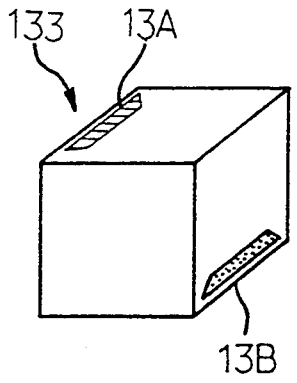
FIG. 8A is a perspective view of side cubic element 133.
Figure 8B:
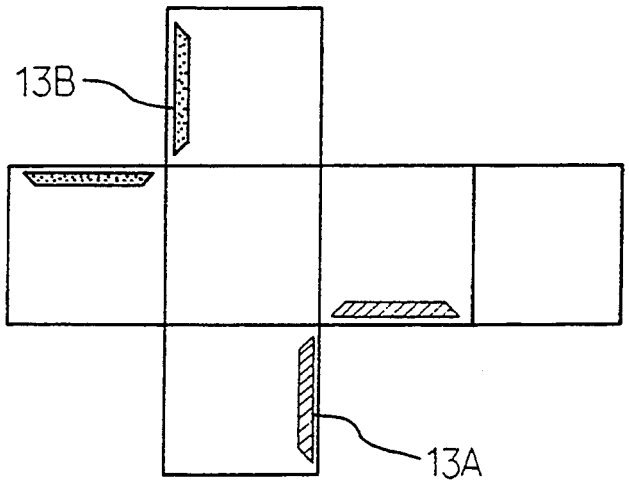
FIG. 8B is an expanded view of side cubic element 133 in FIG. 8A.

In order to readily find the solution when the player confirms that correct position of the empty space, the corner cubic element 33 which is located at the symmetrically opposite position to the empty space, has dots (red dot 33B and blue dot 33A) in the center of each side with the same color as that of the edge lines on the same side. Therefore the multi-cube puzzle is composed of a dotted corner cubic element 33 (as shown in FIGS. 7(A) and 7(B)) and another six corner cubic elements 33 (as shown in FIGS. 6(A) and 6(B), an empty space, and twelve side cubic elements 133 (as shown in FIGS. 8(A) and 8(B)) inserted between the corner cubic elements. The corner cubic elements 33 have blue edge lines 3A on one side and red edge lines 3B directly opposite them as shown in FIG. 6B. The dotted corner cubic elements 33 is shown in FIG. 7. As seen in FIG. 8(A), the front and back sides of the side cubic elements 133 do not have edge lines but the other two sides have adjacent blue edge lines 13A while the remaining two sides have two adjacent red edge lines 13B. The expanded view of that cubic element 133 is described in FIG. 8B.

The enjoyment of this invention lies in discovering the correct location of each cubic element solely by arranging the edge lines of the cubic elements in lines of the same color along the edges of the multi-cube puzzle.

Alternatively, the player may arrange or form a variety of beautiful patterns by mixing colors, for examples, red and blue edge lines. The two sides without colored edge lines have no direct relation to the playing of the game.

In this above mentioned multi-cube puzzle, one corner remains empty in order to let one or two cubic elements be pushed simultaneously. The cubic elements can not be transferred by rotating a row of cubic elements, which is different from the prior method of playing with a cubic puzzle. To explain in detail, each cubic element 3 is moved linearly about the body assembly 100 within tracks 25 defined by the flanges 21 without popping out from the insides of the flanges 21 of the body elements 2. The predetermined pattern can be rearranged along the edges of the multi-cube puzzle 1 because even if each corner cubic element can be fitted to any one of the corner locations, the edge lines might be facing in different directions. The location of an edge lined-cubic element, when the multi-cube puzzle is arranged with the red edge line, will be opposite to that of the same cubic element which is arranged with a blue edge line.

Figure 9:
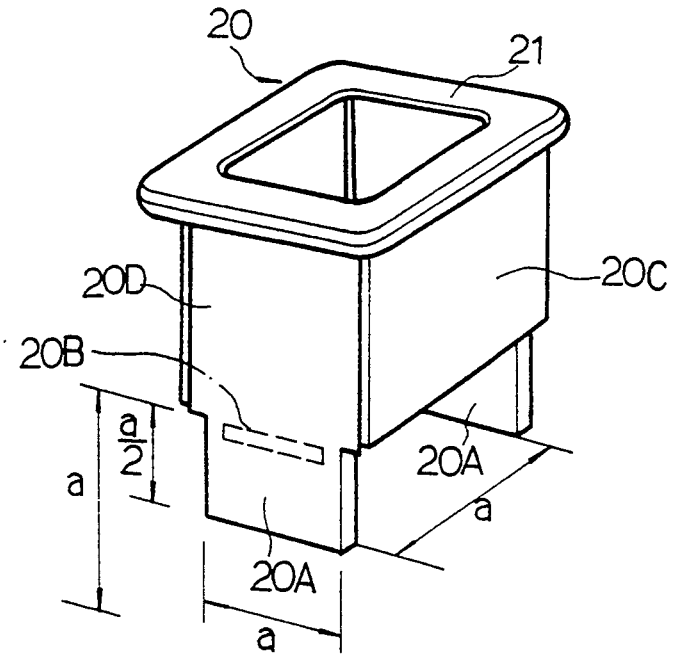
FIG. 9 is another embodiment of body element 20 according to this invention.
Figure 10:
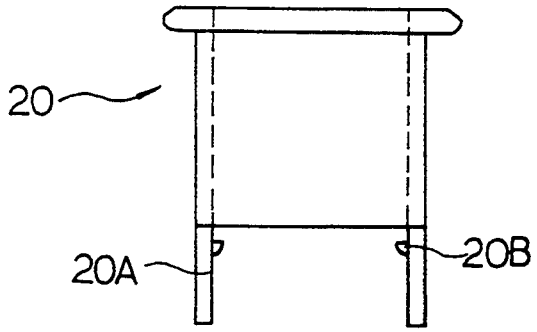
FIG. 10 is a side view of the body element 20 in FIG. 9.
Figure 11:
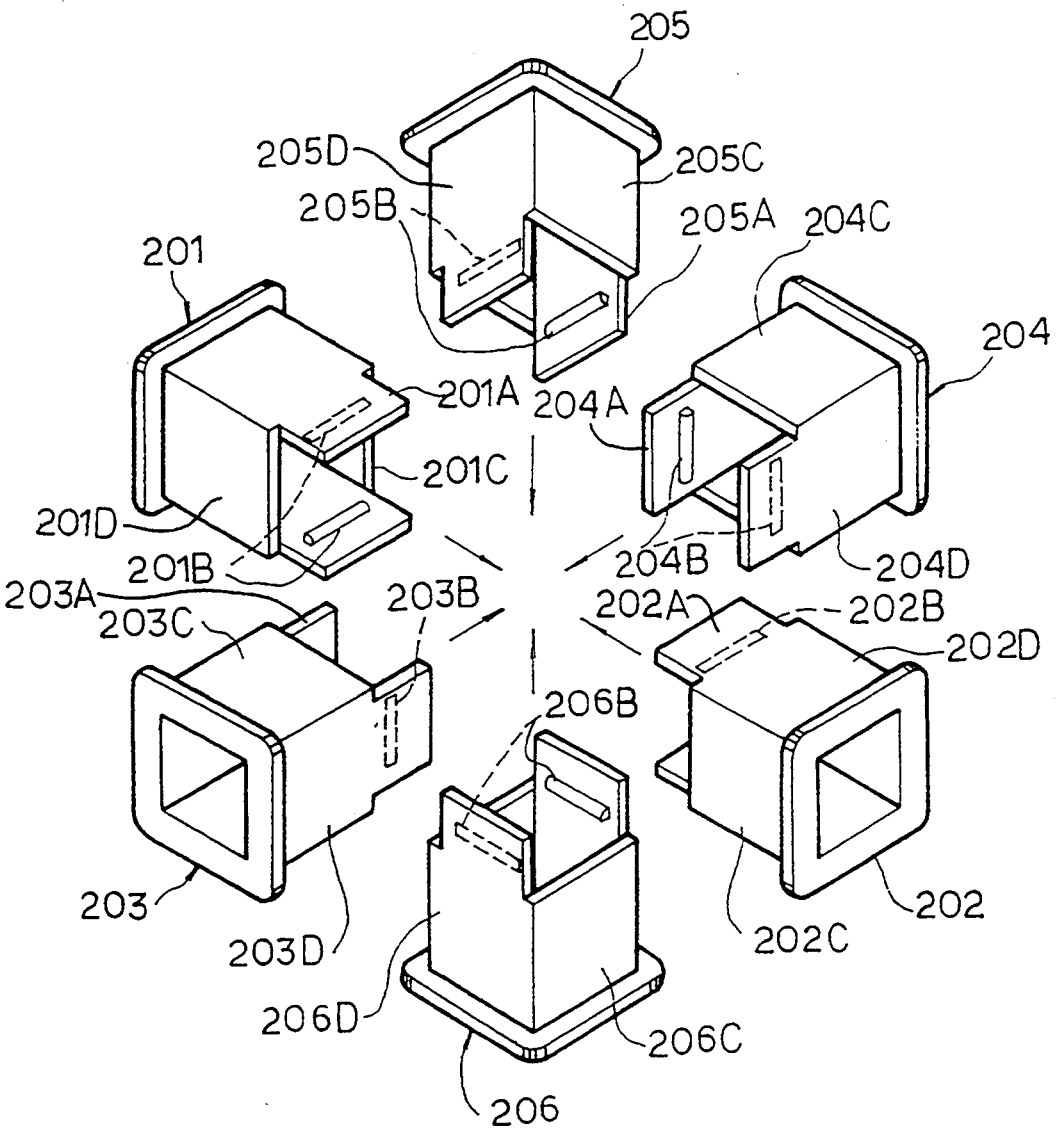
FIG. 11 is a disassembled perspective view of three body element 20 in FIG. 9, aligned for assembly.
Figure 12:
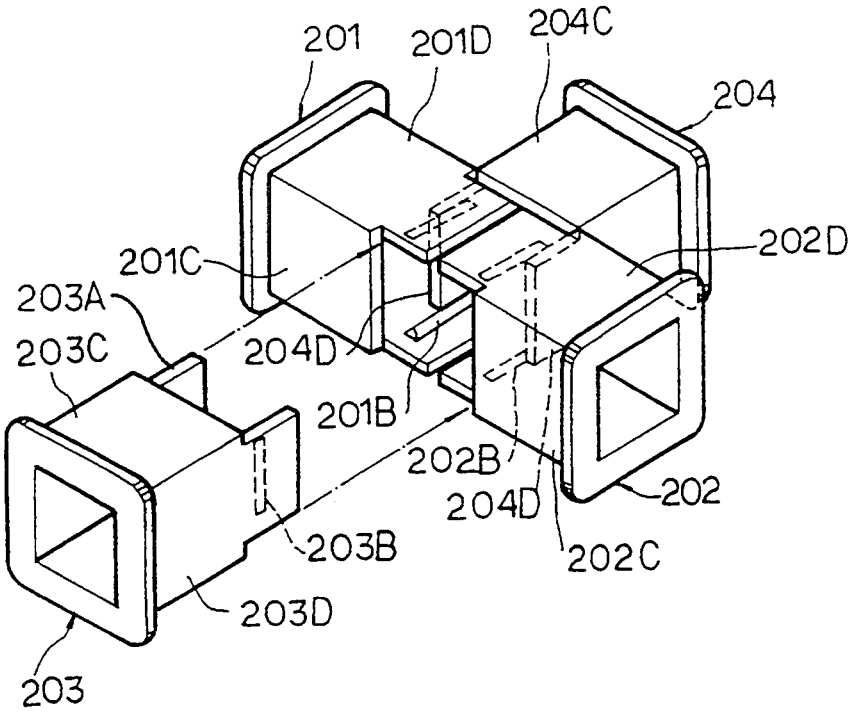
FIG. 12 is a perspective view of a partially assembled body assembly of the second embodiment.
Figure 13:
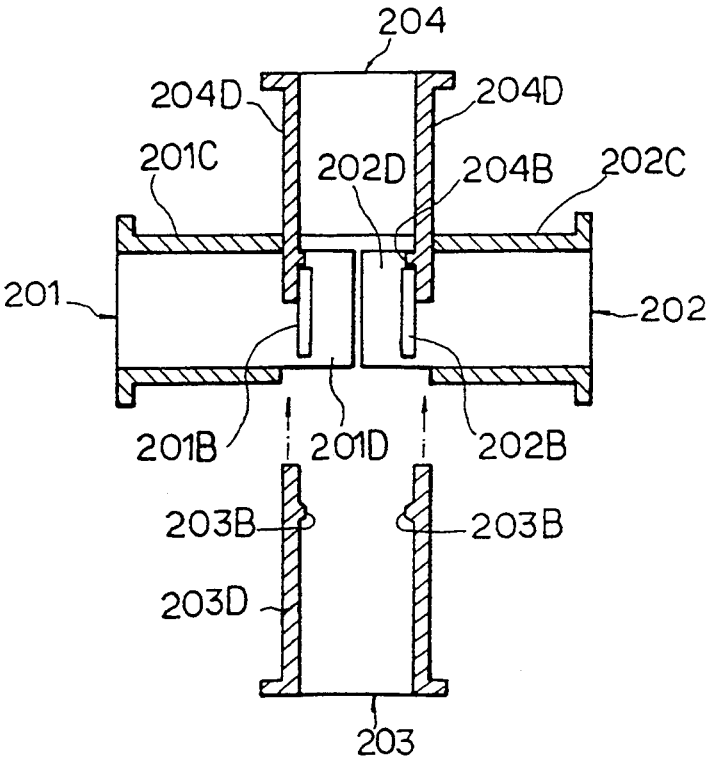
FIG. 13 is a top cross-sectional view of FIG. 12.
Figure 14:
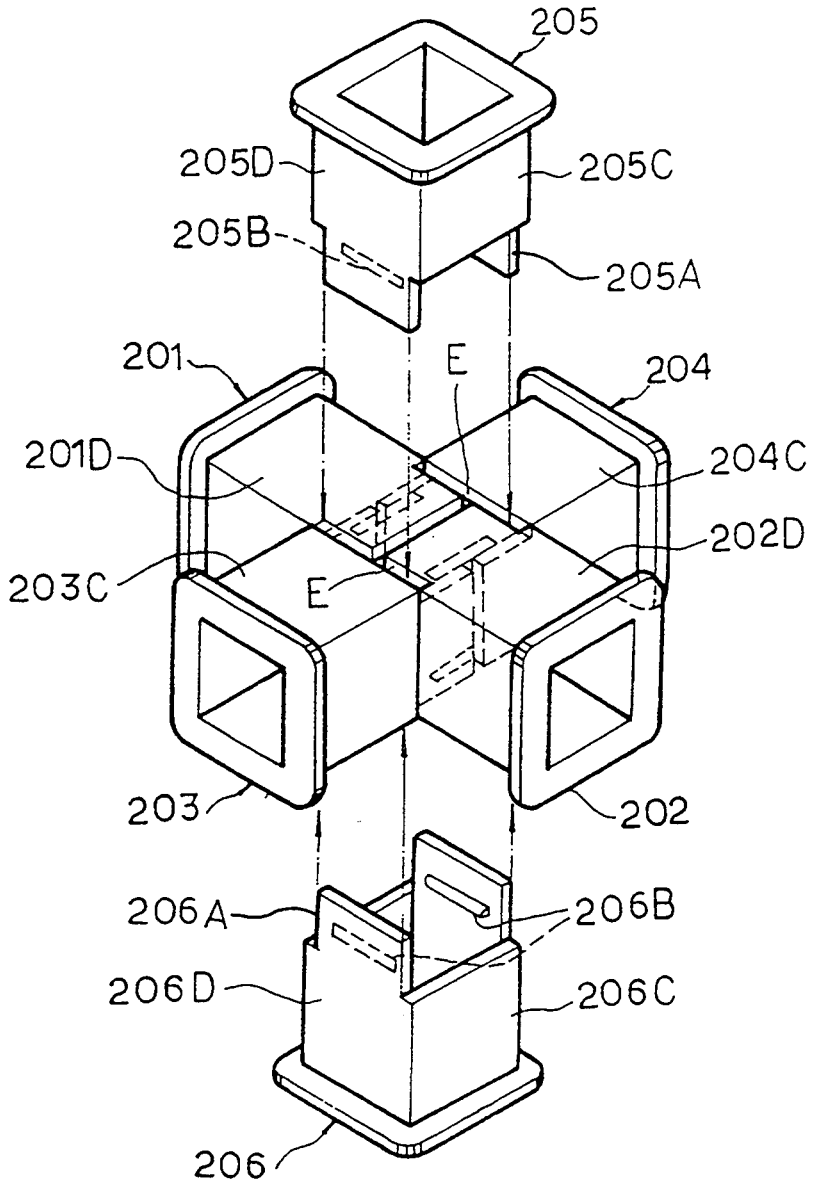
FIG. 14 is a perspective view of the body assembly of FIG. 12 further assembled with top and bottom body elements.
Figure 15:
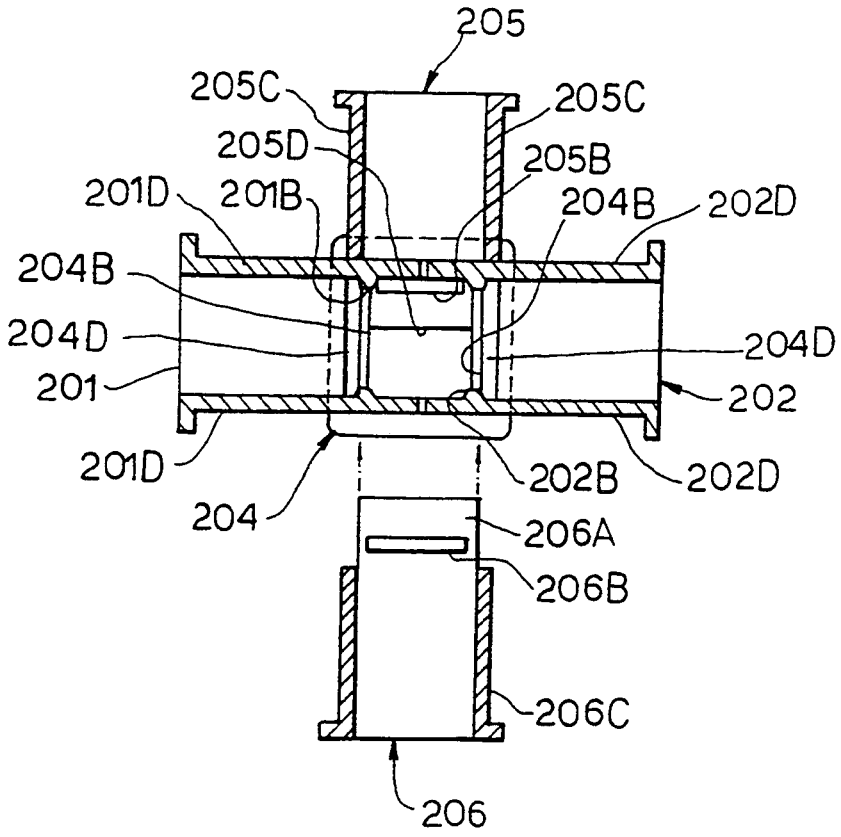
FIG. 15 is a side cross-sectional view of FIG. 14.

Another embodiment of this invention will be explained referring to the following drawings. The second embodiment of body assembly 100, which is fabricated with six body elements 20 of the same type, will be explained with reference to drawings of FIGS. 11–15. FIG. 9 shows the perspective view of a body element generally referred to by reference character 20. FIG. 10 is the side view of FIG. 9 and FIG. 11 is a disassembled perspective view of six body elements 201–206 in FIG. 9, aligned for assembly. FIG. 12 shows a perspective view of a partially assembled body assembly of the second embodiment. FIG. 13 is a top cross-sectional view of FIG. 12. FIG. 14 shows a perspective view of the body assembly of FIG. 12 further assembled with top and bottom body elements. FIG. 15 is a side cross-sectional view of FIG. 14.

As described in FIG. 9, the body element 20 of four side walls 20C, 20D in this embodiment has an opened top with flanges 21 of rounded corners and an opened bottom with two legs 20A which have fixing members 20B inside. Preferably, each of the two opposite side walls 20D has a leg whose length is one half of the width "a" of the side wall 20D or of the width "a" of leg 20A. As seen in FIG. 9, each leg 20A has a lateral dimension less than that of the side wall 20D for forming slit E thereby, as will be discussed below. Further, the leg 20A has a fixing member 20B inside and the length of the leg 20A is "a/2" and the distance between the fixing members 20B of the legs 20A in a body element 20 is "a". Hence, when a pair of body elements 20 are arranged with legs 20A in end-to-end contact, the distance between the fixing members 20B of the two body elements 20 is "a". In this manner, a body assembly 200 can be comprised of six interlocking body elements 20, which is similar to that described in FIG. 4. FIGS. 11–15 show how to interlock the body element in order to form the body assembly 100.

The preferred sequence of assembly of the second embodiment will now be discussed. At first the legs 201A, 202A of body elements 201 and 202, respectively, are brought into contact. Then the legs 203A, 204A of body elements 203 and 204 are inserted into the slits formed by the side walls 201C and 202C and the fixing members 201B and 202B. The legs 203A and 204A are inserted in opposite directions to form a horizontal state of four body elements with interlocking legs 203C and 204C between the fixing members 201B and 202B and the ends of the side walls 201C and 202C. See FIGS. 12 and 13. As a final step in joining the six body elements as a body assembly, the legs 205A and 206A of body elements 205 and 206, respectively, are inserted into the slits E formed between the fixing members 203B and 204B and the ends of the side walls 203C and 204C. In this manner, the fixing members 205B and 206B are coupled with the legs of body elements 201 and 202 so as to be interlocked firmly as a body assembly 100 similar to FIG. 4.

The preferred method of solving the multi-cube puzzle is to arrange the outline of the cube puzzle with red edge lines or blue edge lines by moving one or two cubic elements. When the red edge lines are arranged, the blue edge lines are concealed inside and vise versa. However, various beautiful edge lines of red or blue color can be arranged in accordance with personal techniques.

While the invention has been particularly shown and described with reference to preferred embodiments thereof, it will be understood by those skilled in the art that the above mentioned and other changes in form and details can be made therein without departing from the spirit and scope of the invention.

What is claimed is:

1. A multi-cube puzzle for arranging a defined pattern, the multi-cube puzzle comprising:

a body assembly having a plurality of tracks formed thereon, the body assembly including a plurality of body elements centrally interconnected and extending radially outward, wherein each of the body elements of the body assembly has a bottom with legs extending therefrom which are configured to directly interlock with legs of the other body elements for centrally interconnecting the body elements of the body assembly together, the tracks being formed to extend in at least three different directions; and a number of cubic elements inserted within the tracks for linear movement of the cubic elements around the body assembly, each cubic element including a portion of the defined pattern formed on at least one side thereof.

2. A multi-cube puzzle as claimed in claim 1, wherein the bottom of each of said body elements of the body assembly has a rectangular member and at least one screw hole formed therethrough; and further wherein the body assembly includes a central core having projected members configured to be inserted into the rectangular members and fixed thereto with fasteners inserted through the screw holes.

3. A multi-cube puzzle as claimed in claim 1, wherein the legs of each body element of the body assembly are spaced apart by a distance of "a" and have a length of "a/2", and further wherein fixing members are formed inside the spaced-apart legs of each body element.

4. A multi-cube puzzle as claimed in claim 1, wherein each of the body elements of the body assembly includes side walls and a flange for defining the tracks thereby.

5. A multi-cube puzzle as claimed in claim 4, wherein said body elements of the body assembly are made of transparent material for visibility of sides of the cubic elements which are positioned behind the flanges and the side walls of the body elements.

6. A multi-cube puzzle as claimed in claim 1, wherein the number of cubic elements include twelve side cubic elements and seven corner cubic elements.

7. A multi-cube puzzle as claimed in claim 6, wherein one of the seven corner cubic elements is a dotted corner cubic element having a dot formed on at least one side wall to enable confirmation of proper positioning of the cubic elements relative the dotted corner cubic element.

8. A multi-cube puzzle as claimed in claim 6, the defined pattern of the multi-cube puzzle being formed by edge lines provided on the cubic elements to permit variations of the defined pattern, wherein each of said twelve side cubic elements has two blank sides, two adjacent sides sharing a first common edge with each of the two adjacent sides having an edge line of a first color formed proximate the first common edge, and two additional adjacent sides sharing a second common edge symmetrically opposite the first common edge with each of the two additional adjacent sides having an edge line of a second color formed proximate the second common edge; and each of said seven corner cubic elements has three adjacent sides sharing a first set of common edges, each of the three adjacent sides having edge lines of the first color formed proximate the first set of common edges, and three additional adjacent sides sharing a second set of common edges symmetrically opposite the first set of common edges, each of the three additional adjacent sides having edge lines of the second color formed proximate the second set of common edges, and further wherein said dotted corner cubic element includes a dot of the first color formed on each of the three adjacent sides and a dot of the second color formed on each of the three additional adjacent sides.

9. A multi-cube puzzle for arranging a defined pattern, the multi-cube puzzle comprising:

a body assembly having a plurality of tracks formed thereof, the body assembly including a plurality of body elements made of transparent material, wherein each of the body elements of the body assembly has side walls and a flange for defining the tracks thereby; and a number of cubic elements inserted within the tracks for linear movement of the cubic elements around the body assembly, each cubic element including a portion of the defined pattern formed on at least one side thereof, wherein sides of the cubic elements which are positioned behind the flanges and the side walls of the body elements are visible through the transparent material of the body elements.

10. A multi-cube puzzle as claimed in claim 9, wherein each of the body elements of the body assembly has a bottom with legs extending therefrom which are configured to interlock with legs of the other body elements for centrally interconnecting the body elements of the body assembly together.

11. A multi-cube puzzle as claimed in claim 10, wherein the bottom of each of said body elements of the body assembly has a rectangular member and at least one hole formed therethrough; and further wherein the body assembly includes a central core having projected members configured to be inserted into the rectangular members and fixed thereto with fasteners inserted through the holes.

12. A multi-cube puzzle as claimed in claim 10, wherein the legs of each body element of the body assembly are space depart by a distance of "a" and have a length of "a/2", and further wherein fixing members are formed inside the spaced-apart legs of each body element.

* * * * *

UNITED STATES PATENT AND TRADEMARK OFFICE

CERTIFICATE OF CORRECTION

PATENT NO. : 5,344,147

DATED : September 6, 1994

INVENTOR(S) : Sang-dae Lee

It is certified that error appears in the above-indentified patent and that said Letters Patent is hereby corrected as shown below:

Claim 9, Col.6, line 18, "thereof" should read --thereon --.

Abstract, line 4, "with a fabricated with the" should read --fabricated with a --.

Signed and Sealed this

Twentieth Day of December, 1994

*Attest:*

Bruce Lehman

BRUCE LEHMAN

*Attesting Officer*

*Commissioner of Patents and Trademarks*